United States Patent [19]

Duggan

[11] Patent Number: 5,038,078

[45] Date of Patent: Aug. 6, 1991

[54] DEGAUSSING COIL ATTACHMENT ARRANGEMENT

[75] Inventor: Scott J. Duggan, Indianapolis, Ind.

[73] Assignee: RCA Licensing Corporation, Princeton, N.J.

[21] Appl. No.: 361,075

[22] Filed: Jun. 5, 1989

[51] Int. Cl.[5] ..... H01F 13/00

[52] U.S. Cl. ..... 315/8; 361/150

[58] Field of Search ..... 315/8; 361/150

[56] References Cited

U.S. PATENT DOCUMENTS 4,812,949 3/1989 Prigent ..... 361/150

FOREIGN PATENT DOCUMENTS 2855528 10/1979 Fed. Rep. of Germany ..... 315/8
60-247390 3/1985 Japan .
0233990 11/1985 Japan ..... 361/150
0247390 12/1985 Japan ..... 361/150
1338244 11/1969 United Kingdom ..... 315/8

*Primary Examiner*—Eugene R. LaRoche
*Assistant Examiner*—Amir Zarabian
*Attorney, Agent, or Firm*—Joseph S. Tripoli; Joseph J. Laks; Sammy S. Henig

[57] ABSTRACT

A cathode ray tube has a funnel provided with an outer conductive coating that is electrically isolated from an AC mains supply. An insulated degaussing coil is fitted to the funnel against the outer conductive coating and energized by the AC mains supply in an electrically nonisolated manner. A spring includes a resilient body forming a spring action that snugly fits the degaussing coil against the outer conductive coating. The spring includes a clip for attaching the resilient body to the degaussing coil. At least one of the clip and the resilient body is made of an insulated material for preventing the resilient body from providing a conductive path with respect to electrical shock hazard between the degaussing coil and the electrically isolated outer conductive coating.

4 Claims, 2 Drawing Sheets

DEGAUSSING COIL ATTACHMENT ARRANGEMENT

This invention relates to an arrangement for attaching a degaussing coil to a cathode ray tube (CRT).

Color cathode ray tubes require periodic degaussing or demagnetization to counteract the effects of the earth's magnetic field or of electromagnetic fields produced by nearby electrical devices, such as motors or appliances. These fields may magnetize metallic portions of the cathode ray tube, such as the shadow mask or the magnetic shield, causing a degradation of the color purity of the tube. Video display apparatus, such as television receivers and computer or video display monitors, usually incorporate a degaussing circuit which is operative when the apparatus is energized to produce an alternating current field that decays toward zero in order to demagnetize the metallic components in the vicinity of the tube and of the tube itself.

A common type of degaussing circuit that includes the degaussing coil is powered from the AC line supply, which in the United States has a frequency of 60 Hz. The degaussing coil is preferably fitted closely to the surface of the back portion of the CRT enclosure or envelope. The close fitting is desirable in order to maximize the strength of the degaussing field inside the CRT.

In one prior art degaussing coil assembly, the degaussing coil is attached to the CRT by wire ties and plastic clips. Tension caused by the wire ties arrangement holds the degaussing coil snugly against the funnel of the CRT.

A more recently used assembly of degaussing coil referred to as the "twisted-loop" type is shown in FIG. 1. In such arrangement the degaussing coil assembly may be preformed in one location to include a metal spring 100 for producing a required mechanical tension. The preformed degaussing coil includes a U-shaped portion. The U-shaped portion partially surrounds a neck of the CRT that extends backward. The neck of the CRT carries electrical connectors for providing, among other voltages, video signals to the CRT.

The preformed degaussing coil assembly may be shipped to a different factory location where it is fitted on the funnel of the CRT. In order to fit the preformed degaussing coil on the funnel of the CRT, four plastic lead dress clips, 10–13, that are located close to the corners of the CRT may be utilized. Firstly, corresponding portions of the preformed degaussing coil are inserted into, for example, dress clips 10,11 and 12. Then, metal spring 100 is manually stretched to enable the insertion of the corresponding bottom left portion of the degaussing coil into clip 14. As a result of the tensile force exerted by metal spring 100, tension is created in the wire of the degaussing coil that causes the degaussing coil to be fitted snugly against the funnel of the CRT. Thus, instead of creating the required tension in the wire merely by wire tie operation, the tension is caused by spring 100.

Metal spring 100 of such prior art arrangement is an elongated coiled metal spring having two ends. One end is tied, using a plastic wire tie, to one of the pair of corresponding portions of the U-shaped portion of the degaussing coil. The other end is tied, using a second plastic wire tie, to the other one of the pair of corresponding portions of the U-shaped portion of the degaussing coil. Disadvantageously, using the plastic wire ties increases the labor cost.

It may be desirable to reduce the labor cost associated with utilizing the plastic wire ties without increasing the risk of electrical shock hazard, as explained in more detail below.

To simplify coupling of signals between the external devices such as a video tape recorder and the television receiver, the common conductors of the receiver and of the external devices are connected together so that all are at the same potential. The signal lines of the external devices are coupled to the corresponding signal terminals of the receiver. In such an arrangement, the common conductor of each device, such as the television receiver, may be held "floating", or conductively isolated relative to the corresponding AC mains supply source that energizes the device. The AC mains supply source is conductively coupled with respect to electrical shock hazard to the degaussing coil during a degaussing interval. Because the common conductor is held floating, a user touching a terminal that is at the potential of the common conductor will not suffer an electrical shock. Such electrical shock might occur if the common conductor were not held floating.

Thus, the common conductor, or ground, of, for example, the television receiver is, typically, isolated from the potentials at the terminals of the AC mains supply source that provides power to the receiver and to the degaussing coil. The isolated common conductor is sometimes referred to as "cold" ground conductor.

In order to form a sufficiently large filter capacitance, that is in the order of 2000 pF, between an anode of the CRT where an ultor voltage is developed and the cold ground conductor, the funnel portion of the CRT is coated with an external conductive coating. The external conductive coating, sometimes referred to as the aquadag, is conductively coupled with respect to electrical shock hazard to the cold ground conductor via a copper brade, not shown in FIG. 1. It may be desirable to reduce the risk of electrical conduction from the degaussing coil to the external conductive coating so as to prevent electrical shock hazard.

The degaussing coil is typically covered with a plastic insulator sheath. Plastic wire ties are used for connecting the metal spring to the degaussing coil wire, as described before. Nevertheless, it has been found that the ends of metal spring 100 might pierce the plastic sheath and make electrical contact with the conductor of the degaussing coil. Should such piercing occur and should the metallic coils of spring 100 make electrical contact with the external conductive coating, the cold ground conductor might be conductively coupled with respect to electrical shock hazard to the AC mains supply voltage through the degaussing coil. Such situation is hazardous and should be, preferably, prevented.

A cathode ray tube assembly, embodying an aspect of the invention, includes a cathode ray tube, an insulated degaussing coil and a spring. The cathode ray tube has a funnel provided with an outer conductive coating that is electrically isolated from an AC mains supply. The insulated degaussing coil is fitted to the funnel against the outer conductive coating and energized by the AC mains supply in an electrically nonisolated manner. The spring includes a resilient body forming a spring action that snugly fits the degaussing coil against the outer conductive coating. The spring includes a clip for attaching the resilient body to the degaussing coil. At least one of the clip and the resilient body is made of an insulator material for preventing the resilient body from providing a conductive path with respect to electrical shock hazard between the degaussing coil and the electrically isolated outer conductive coating.

Figure 1:
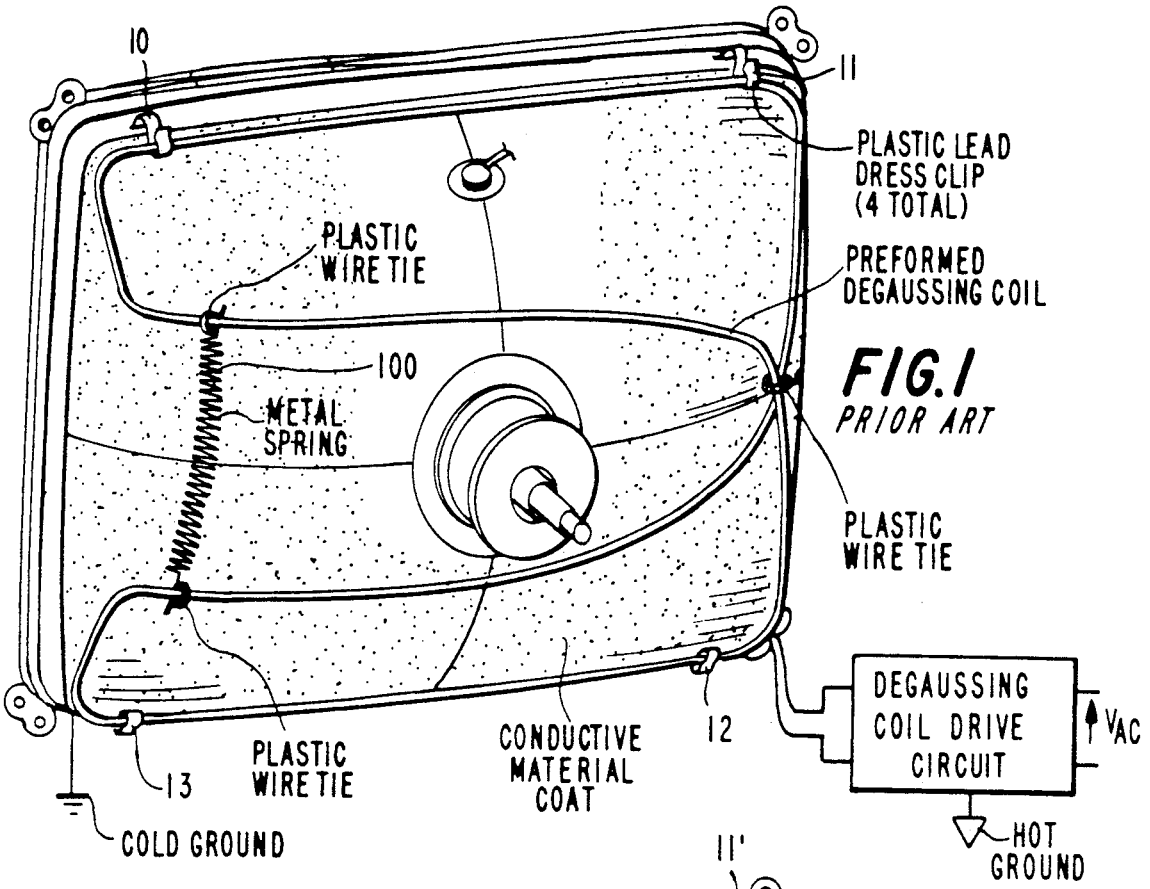
FIG. 1 PRIOR ART
FIG. 1 illustrates a back view of a CRT that is fitted with a preformed degaussing coil utilizing a prior art metal spring.
Figure 2:
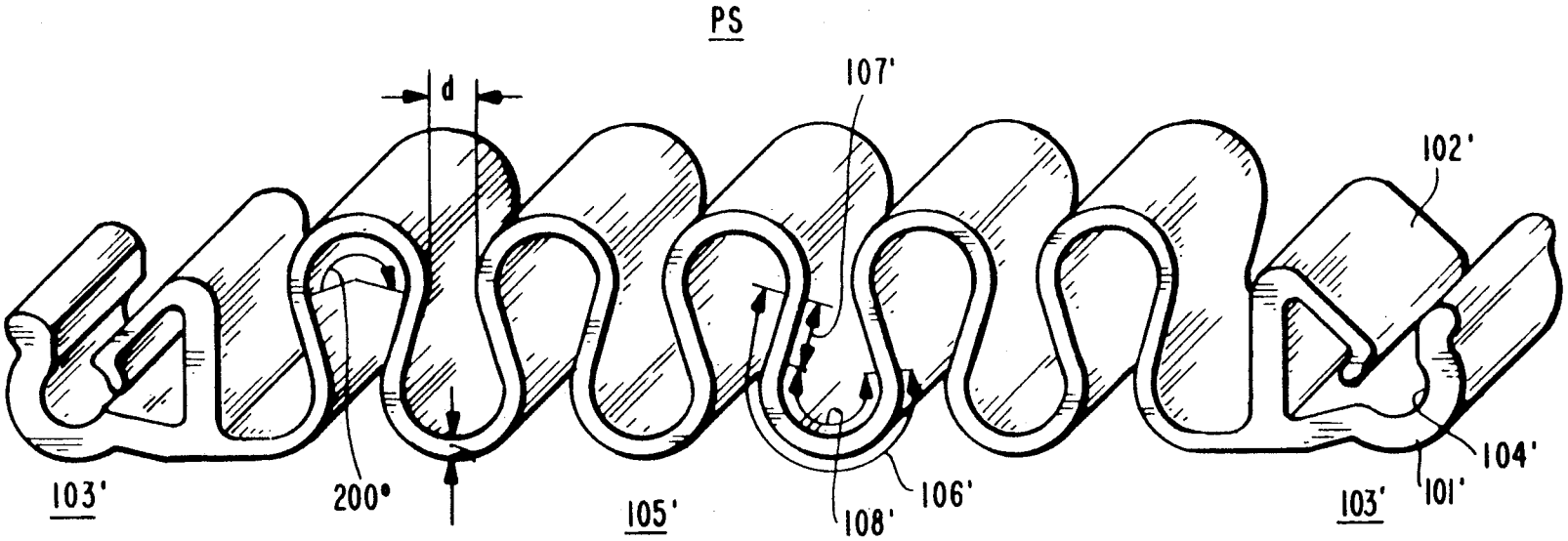
FIG. 2 illustrates a perspective view of a plastic spring, embodying an aspect of the invention.

FIG. 2 illustrates a plastic spring 100 embodying an aspect of the invention. Plastic spring 100' is utilized to hold snugly a degaussing coil 300 of FIG. 3 of the twisted loop type to the funnel of a CRT. The function and construction of degaussing coil 300 is similar to those explained before with respect to FIG. 1. Similar numerals and symbols in FIGS. 1–3 indicate similar items or functions.

Figure 3:
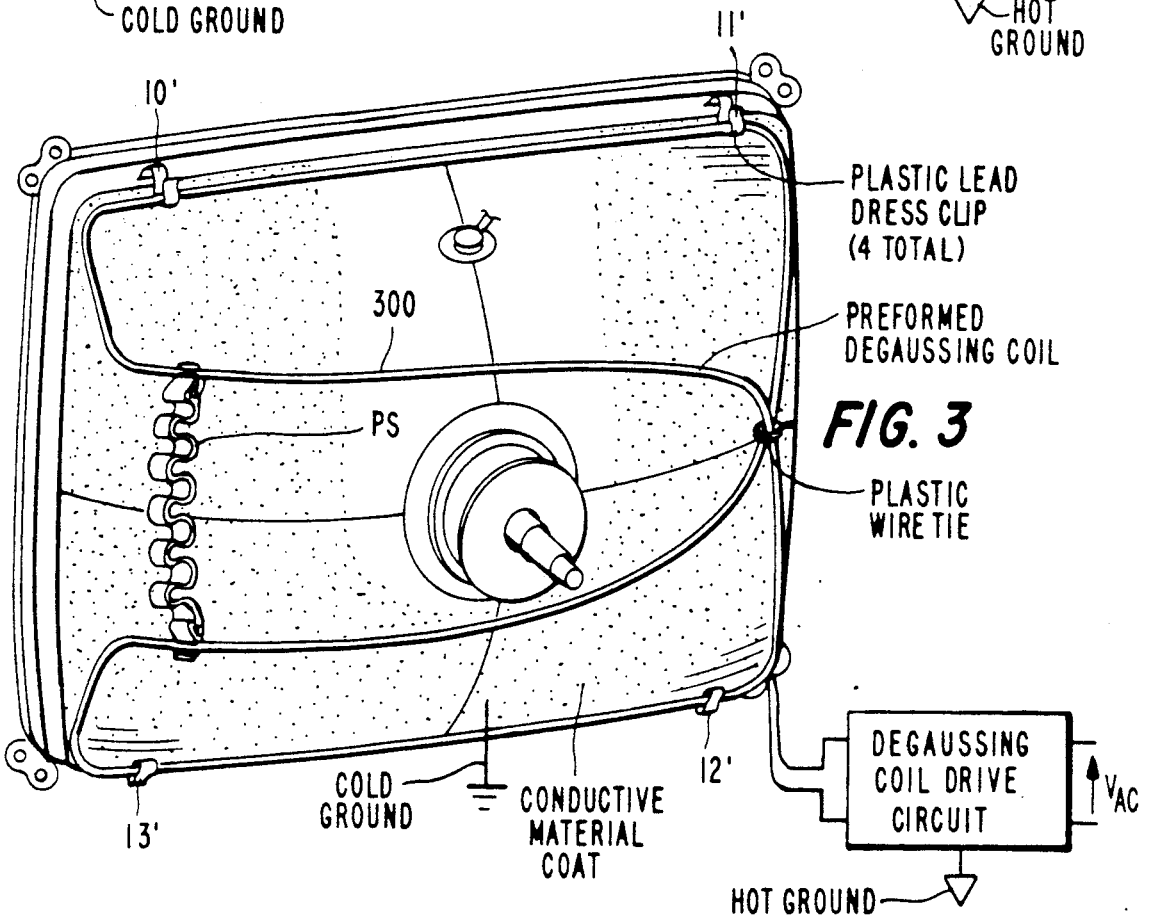
FIG. 3 illustrates a back view of a CRT that is fitted with a preformed degaussing coil utilizing the plastic spring of FIG. 2, embodying an aspect of the invention.

In accordance with an aspect of the invention, a plastic spring PS of FIG. 3 provides the mechanical function of snugly fitting degaussing coil 300 against the funnel of CRT 110. Advantgageously, spring PS is made in its entirety, for example, from a plastic material.

In accordance with another aspect of the invention, plastic spring PS of FIG. 2 has a pair of end clip portions 103' made of plastic material that are intended to be clipped to the corresponding portions of the U-shaped portion of degaussing coil 300 of FIG. 3. Each of clip portions 103' of FIG. 2 includes an arcuate receptacle 101' for receiving in its arcuate channel 104' the plastic sheath covered wire of the degaussing coil of FIG. 3.

A given one of clip portions 103' of FIG. 2 further includes a flexible plastic flap 102' that is intended to hold the plastic sheath covered wire of degaussing coil 300 of FIG. 3 tightly in channel 104' of FIG. 2. As a result of the operation of flap 102', clip portion 103' provides sufficient mechanical interference with the plastic sheath covered wire of the degaussing coil of FIG. 3 that prevents plastic spring PS from sliding on the wire of the degaussing coil.

Clip portion 103' of FIG. 2 is designed to snap onto the wire of degaussing coil 300 of FIG. 3 with a straight line motion. Thus, the time required for manually attaching spring PS is, advantageously, reduced relative to the time required for attaching metal spring 100 of FIG. 1. Advantageously, clip portions 103' of FIG. 2, made entirely of a plastic material, form insulators that inherently prevent the risk of electrical shock hazard. Electrical shock hazard has been discussed before with respect to metal spring 100 of FIG. 1.

Spring PS of FIG. 2 includes a serpentine resilient body or portion 105', made of plastic material, that provides the required elongation characteristic of spring PS. Serpentine portion 105' can be considered as including several segments 106'. Adjacent segments 106' form a corresponding serpentine, incomplete loop. A portion of each segment 106' is formed by a straight link 107' and by an arcuate portion 108'. Except for portions 108' located at the ends of spring PS close to clips portion 103', the cross section of each intermediate portion 108' defines approximately 200° of a full circle.

In accoordance with another aspect of the invention, by having at least one of resilient body 105' and the corresponding clip portion 103, made of a plastic material, spring body 105' is prevented from providing a conductive path with respect to an electrical shock hazard between degaussing coil 300 and the conducting material coating that covers a portion of the funnel of CRT 110.

It may be desirable to design spring PS in such a way that the force required to stretch it a given distance in the direction of its length does not appreciably exceed that required for fitting the degaussing coil of FIG. 3 onto the funnel of the CRT snugly. This is so in order to facilitate the manual operation of fitting degaussing coil 300 on the CRT funnel and also because the larger the force the greater the tendency of spring PS to break.

In designing spring PS, it should be taken into account that the larger the radius of arcuate portion 108' and the longer the height of link 107', the less force required to stretch spring PS a given distance. On the other hand, increasing the height of link 107' will make spring PS more bulky and less convenient for shipping purposes. It should also be taken into account that the thinner a wall width W of spring PS, the less the force that is required but the more difficult it is to mold such spring. Furthermore, sharp transitions along the cross section of serpentine 105', preferably, should be avoided to prevent an excessive stress in the plastic material. Such excessive stress might tend to cause spring PS to break.

It may be desirable to facilitate shipping of a large number of spring units such as spring PS of FIG. 2 in a bulk shipping container prior to or after being attached to the corresponding degaussing coils. Therefore, it may be desirable to pile a large number of such units of spring PS without additional packing precautions. To that end, it may be desirable to design the geometry of spring PS in such a way that a given spring PS will resist tangling with any other spring PS in such pile.

In accordance with a feature of the invention, a width of an opening d, for example, above a given arcuate portion 108' of a given spring PS is designed to be smaller than substantially any other portion or dimension of spring PS. Thus, when a given pair of units of spring PS are in physical contact with each other, tangling is, advantageously, avoided.

The plastic material used for producing spring PS may be of the material having the trade name LEXAN, BE-3030 that is marketed by General Electric Corporation. Spring PS may be produced using a plastic extrusion process that only requires as an additional operation the cutting of the extended material to the required width of spring PS. Alternatively, spring PS may be produced by an injection molding process.

What is claimed is:

1. A cathode ray tube assembly comprising:

a cathode ray tube having a funnel provided with an outer conductive coating, said outer conductive coating being electrically isolated from an AC mains supply;

an insulated degaussing coil fitted to said funnel against said outer conductive coating and energized by sad AC mains supply in an electrically nonisolated manner; and a spring attached to said degaussing coil, said spring including:

(a) a resilient a body having a first length when said degaussing coil is detached from said cathode ray tube and having a second length that is substantially different from said first length when said degaussing coil is fitted to said funnel, said resilient body forming a spring action that snugly fits said degaussing coil against said outer conductive coating;

(b) a clip for attaching said resilient body to said degaussing coil, at least one off said clip and said resilient body being made of an insulator material for preventing said resilient body from providing a conductive path with respect to electrical shock hazard; between said degaussing coil and said electrically isolated outer conductive coating; and (c) a second clip that is attached too said resilient body of said spring such that said spring is capable of being attached between corresponding portions of said degaussing coil, wherein each of said first and second clips and said resilient body of said spring is made of plastic material.

2. An assembly according to claim 1 wherein said first and second slips and said resilient body that is interposed therebetween are produced simultaneously by an extrusion or by a molding process.

3. A cathode ray tube assembly, comprising:

a cathode ray tube having a funnel provided with an outer conductive coating, said outer conductive coating being electrically isolated from an AC mains supply;

an insulated degaussing coil fitted to said funnel against said outer conductive coating and energized by said AC mains supply in an electrically nonisolated manner; and a spring attached to said degaussing coil, said spring including:

(a) a resilient body having a first length when said degaussing coil is detached from said cathode ray tube and having a second length that is substantially different from said first length when said degaussing coil is fitted to said funnel, said resilient body forming a spring action that snugly fits said degaussing coil against said outer conductive coating;

(b) a clip for attaching said resilient body to said degaussing coil, at least one of said clip and said resilient body being made of an insulator material for preventing said resilient body from providing a conductive path with respect to electrical shock hazard, between said degaussing coil and said electrically isolated outer conductive coating;

a second clip that is attached to said resilient body of said spring such that said spring is capable of being attached between corresponding portions of said degaussing coil wherein each of said first and second clips and said resilient body of said spring is made of plastic material wherein said resilient body has a serpentine shape and wherein said serpentine shaped resilient body includes a plurality of serpentine shaped segments such that a given one of said segments includes a straight link portion and an arcuate portion.

4. An assembly according to claim 3 wherein a dimension of an opening that is formed above said arcuate portion of a given one of said serpentine shaped segments is sufficiently small relative to other dimensions of said spring for preventing tangling of said spring with a similar unit when such units are in physical contact with each other so as to facilitate shipping of said spring units.

* * * * *